United States Patent [19]

Creed

[11] Patent Number: 4,697,539

[45] Date of Patent: Oct. 6, 1987

[54] ARRANGEMENT FOR INTERCONNECTING CONCRETE PONTOONS

[75] Inventor: John Creed, Ski, Norway

[73] Assignee: Smabathavner a.s, Oslo, Norway

[21] Appl. No.: 878,083

[22] Filed: Jun. 24, 1986

[30] Foreign Application Priority Data

Jun. 24, 1985 [NO] Norway ..... 852526

[51] Int. Cl.[4] ..... B63B 35/00

[52] U.S. Cl. ..... 114/266; 114/263

[58] Field of Search ..... 114/49, 46, 77 A, 77 R, 114/264, 266, 267, 263, 249, 251; 14/2.6, 27, 29, 30

[56] References Cited

U.S. PATENT DOCUMENTS

| | | | |
|---|---|---|---|
| 2,705,933 | 4/1955 | Quirin | 114/46 |
| 2,732,818 | 1/1956 | Quirin | 114/77 R |
| 4,321,882 | 3/1982 | Sluys | 114/266 |
| 4,449,471 | 5/1984 | van Roon | 114/251 |

*Primary Examiner*—Jeffrey V. Nase
*Assistant Examiner*—Jesûs D. Sotelo
*Attorney, Agent, or Firm*—Fleit, Jacobson, Cohn & Price

[57] ABSTRACT

Arrangement for interconnecting concrete pontoons for small boat harbors, fish raising plants and the like, are subjected to very severe stresses as a result of wave movements and the like. In order to obtain a more safe and reliable interconnecting arrangement at least one side or end of each pontoon (1) has two bumper surfaces (11AF, 12AF), spaced from each other and adapted to face against and cooperate with corresponding two bumper surfaces (11BF, 12BF) on another pontoon (2). Between the respective bumper surfaces on two interconnected pontoons there is mounted a fender (11, 12) which is compressed with a significant degree of prestressing. One pontoon (1) has two symmetric and laterially located attachment members (17, 18) each for å separate tension element (13, 14). The other pontoon (2) has an attachment member (15) centrally between its bumper surfaces (11BF, 12BF) for the common anchoring of both tension elements (13, 14). There is provided for a certain degree of articulate or rotary motion in the anchoring of the tension elements (13, 14) to the attachment members (15, 17, 18). In principle the arrangement may be considered to function as a universal joint.

6 Claims, 2 Drawing Figures

ARRANGEMENT FOR INTERCONNECTING CONCRETE PONTOONS

Figure 1:
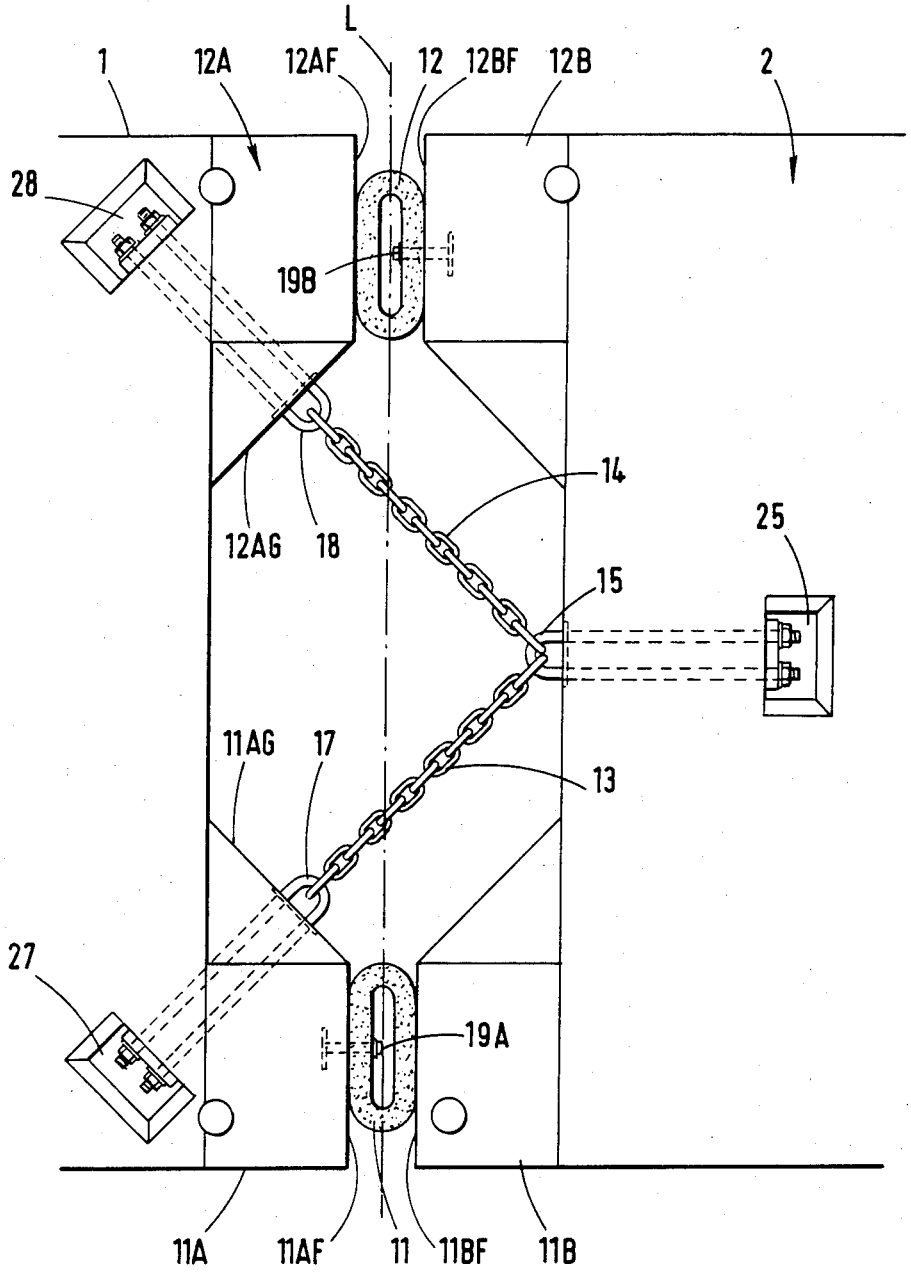

Concrete pontoons are widely used in small boat harbours, fish raising plants and the like, where, inter alia, there is obtained a desired wave damping by means of such pontoons. These concrete pontoons are comparatively heavy and usually have a rectangular, elongate shape intended for interconnection end-to-end in a suitable number for the situation of interest. Earlier for this interconnection of pontoons there have been used conventional means, such as fenders, chains and so on. Wave movements and other forces acting on such harbour installations with concrete pontoons will, however, lead to heavy stresses on the interconnection arrangement. During an extended time such stresses may lead to failure in the connection and thereby the possibility of accidents or damage which require expensive repairs. Failure in the known interconnection arrangements occur both when these are designed with a slack coupling between the pontoons and when it has been attempted to establish a tight coupling.

Based upon components and means being known per se, this invention aims at providing a substantially improved interconnection arrangement for concrete pontoons for small boat harbours, fish raising plants and the like. What is novel and specific to the arrangement according to the invention in the first place consists therein that at least one side or end of each pontoon has two bumper surfaces spaced from each other and adapted to face against and cooperate with corresponding two bumper surfaces on another pontoon, that between respective bumper surfaces on two interconnected pontoons there is mounted a fender which is compressed with a significant degree of prestressing, that one of the pontoons has two symmetrical and laterally positioned attachment members each for a separate tension element, and that the other pontoon centrally between its bumper surfaces has an attachment member for the common anchoring of both tension elements, and that the anchoring of the tension elements in the attachment members allows a certain degree of articulate or rotary motion.

A particularly advantageous embodiment is obtained by providing for each tension element to form an angle of approximately 45 degrees with a line drawn through the central points of both fenders.

With the usual design of pontoons as mentioned above, i.e. with an elongate, rectangular shape, the two tension elements will form an angle of preferably 45 degrees also with the longitudinal axis through the pontoons. Such an arrangement of the tension elements, combined with the prestressed fenders, makes the coupling able to withstand very large forces both in the longitudinal direction of the pontoon installation as in the transverse direction thereof. At the same time there will be obtained a significant degree of flexibility in the connection, in particular because the common and centrally located attachment member for the tension elements on one of the two adjacent pontoon ends, represents a form of universal joint which makes possible an angular movement between both interconnected pontoons in all planes. Nevertheless, the mutual distance between the pontoon ends is all the time kept substantially unchanged.

As tension elements it is preferable according to the invention to employ chains, but it may also be contemplated to employ rigid rods, wires or the like, provided that these are anchored to the attachment members with a certain possibility of articulate or rotary motion.

As the two fenders there may be employed various commercially available fender types, for example spherical, cylindrical or other fender shapes. The shape of the fenders in unloaded condiction is less essential since the fenders in all cases when mounted in the arrangement according to the invention, will be significantly compressed and thereby somewhat flattened so as to have a comparatively large surface area engaging the bumper surfaces on the pontoons. The compression or prestressing of the fenders may take place during the coupling of two pontoons to each other, for example by pulling these together with fenders lying between them, by means of a jack or a hoist. Then the tension elements are mounted and the coupling is established so that the prestressing of the fenders always keep the tension elements tight. Another way of providing for prestressing is to employ fenders being inflateable by air pressure, the inflating being carried out after mounting of the fenders between the pontoons and with the tension elements in position.

Figure 2:
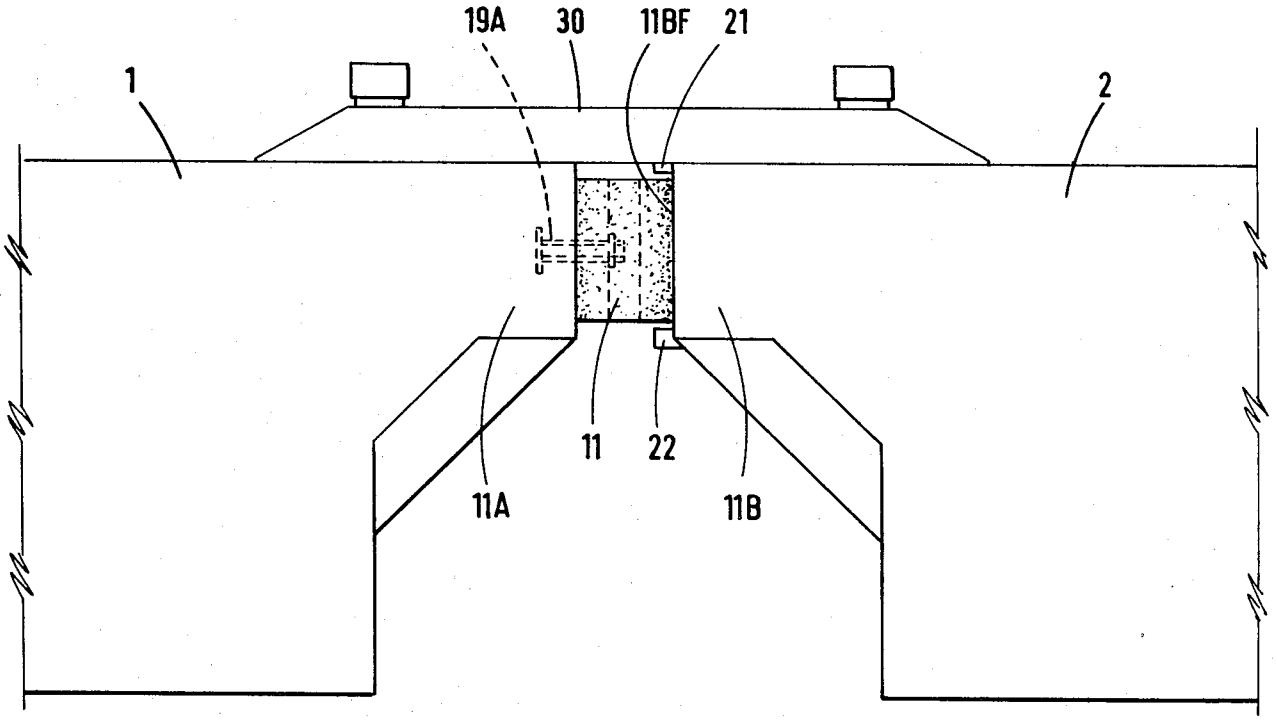

In the following description the invention shall be explained more closely with reference to the drawing, in which:

FIG. 1 shows two pontoon ends in plane view and provided with an interconnection arrangement according to the invention, and FIG. 2 shows the arrangement of FIG. 1 in elevation.

In the drawings there are shown end portions of two pontoons 1 and 2 which may be of a design as known per se with concrete as the main material. Reinforcement, float elements, etc. may be incorporated in the design in the usual manner. In particular the reinforcement will be included with due regard to the forces which occur in the special form of interconnection arrangement proposed here.

At the ends of both pontoons 1 and 2 there are provided projections 11A and 12A,respectively 11B and 12B having respective bumper surfaces 11AF, 12AF and 11BF, 12BF facing each other. Between these bumper surfaces there are mounted two fenders 11 and 12 being fastened to the projection at one side by means of respective bolts 19A and 19B.

Centrally at the end of pontoon 2 there is mounted an attachment member 15 in the form of a U-bolt and corresponding attachment members 17 and 18 are mounted at the end of pontoon 1, more particularly at an inclined surface 11AG and 12AG respectively, on the two projections 11A and 12A. The relative dimensions have been chosen so that tension elements in the form of chains 13 and 14 between the attachment members on the two pontoon ends, form an angle of approximately 45 degrees with the longitudinal axis of the pontoons. In other words the chains will also form an angle of approximately 45 degrees with an imaginary line L through the central points of the two fenders. Depending inter alia upon the expected stresses in the longitudinal and transverse direction respectively, of the connection, this angle may of course be varied, but in any circumstances the attachment member 15 constitutes a central pivot point corresponding in the principle to a universal joint which makes possible mutual angular movement between the two pontoons in all planes.

It is a great advantage that all components included in the connection arrangement described, may easily be replaced. Thus, the U-bolts shown which form the attachment members 15, 17, 18 are inserted into corresponding holes through the cast concrete and protrude into recesses 25, 27 and 28 respectively, in the concrete surface, in order to make possible the loosening and the tightening respectively, of nuts at the ends of the bolts.

As apparent from FIG. 2 there may be arranged a wooden ramp 30 across the coupling so that it will be easy to walk and possibly drive, across the coupling between the individual pontoons. Moreover, as usual the pontoons may be provided with other auxiliary devices, such as attachment points for anchoring to the sea bottom.

Still another important detail is seen in FIG. 2 in relation to the fender 11. As mentioned this fender is fastened with a bolt 19A to the bumper surface on protrusion 11A. However, in the principle the fender 11 at the other side is free to slide or being displaced in all directions against the bumper surface 11BF. In order to prevent such mutual displacement upon wave movements for example, from leading to a more or less permanent skew between the two pontoon ends being connected, there are provided guide elements 21 and 22 at the upper and lower edges respectively, of the portion of the fender being in engagement with bumper surface 11BF.

The embodiment shown is based upon the most common pontoon shape, i.e. with a comparatively elongate, rectangular main shape, at which the interconnection takes place at the short ends of the pontoons. At other possible pontoon shapes, for example polygonal pontoons, the connection may be established in a quite analogous manner at one or more sides of the pontoon, each such side being provided with two bumper surfaces with two fenders mounted thereto, and provided with corresponding attachment members and tension elements in analogy to what has been described above.

With an interconnection arrangement as described here, wave movements will involve in substance a pure articulating function in the connection means shown, whereas any mutual vertical motion of the pontoons at their ends, will be relatively neglectable.

In practical embodiments of pontoons with an arrangement according to the invention, there may of course be made various modifications in relation to the embodiment described. For example the fender bumping surfaces may directly constitute a portion of the end faces of the pontoons, i.e. without the projections described. Although it is an advantage that the fenders and the tension elements lie in the same horizontal plane above the water level, embodiments may be contemplated in which the components of the interconnection arrangement are immersed into the water.

I claim:

1. Arrangement for interconnecting pontoons of concrete for small boat harbours, fish raising plants and the like, wherein at least one side or end of each pontoon has two bumper surfaces at a spacing from each other and adapted to face against and cooperate with corresponding two bumper surfaces on another pontoon, between respective bumper surfaces on two interconnected pontoons there is mounted a fender which is comppressed with a significant degree of prestressing, one pontoon has two symmetric and laterally positioned attachment members each for a separate tension element, the other pontoon centrally between its bumper surfaces has an attachment member for the common anchoring of the two tension elements, and the anchoring of the tension elements in the attachment members allows a certain degree of articulate or rotary motion.

2. Arrangement according to claim 1, wherein each tension element forms an angle of approximately 45 degrees with a line drawn through the central points of the two fenders.

3. Arrangement according to claim 1 wherein the tension elements are chains.

4. Arrangement according to claim 1, wherein the bumper surfaces are provided on projections from the side or end concerned on each pontoon.

5. Arrangement according to claim 4, wherein the projections on one pontoon side or end have laterally and inwardly inclined surfaces in which the symmetrically positioned attachment members are located.

6. Arrangement according to claims 1, wherein there is provided a guide element in the bumper surfaces at one pontoon side or end at the upper and lower edges of the fender, for counteracting any permanent mutual skew of the interconnected pontoon sides or ends vertically in relation to each other, the fender being rigidly anchored to the cooperating bumper surface.

* * * * *